US011697113B2

(12) United States Patent
Reichmuth

(10) Patent No.: US 11,697,113 B2
(45) Date of Patent: Jul. 11, 2023

(54) METHOD FOR DOSING LIQUID BY MEANS OF A PIPETTE AND A SYRINGE, AND PIPETTE FOR ACTUATING A SYRINGE FOR DOSING LIQUID

(71) Applicant: Eppendorf AG, Hamburg (DE)

(72) Inventor: Burkhardt Reichmuth, Hamburg (DE)

(73) Assignee: Eppendorf AG, Hamburg (DE)

( * ) Notice: Subject to any disclaimer, the term of this patent is extended or adjusted under 35 U.S.C. 154(b) by 430 days.

(21) Appl. No.: 16/934,243

(22) Filed: Jul. 21, 2020

(65) Prior Publication Data

US 2021/0001326 A1 Jan. 7, 2021

Related U.S. Application Data

(62) Division of application No. 15/844,921, filed on Dec. 18, 2017, now Pat. No. 11,154,854.

(30) Foreign Application Priority Data

Dec. 16, 2016 (EP) ..... 16204865

(51) Int. Cl.
*B01L 3/02* (2006.01)

(52) U.S. Cl.
CPC ..... *B01L 3/0224* (2013.01); *B01L 3/0234* (2013.01); *B01L 3/0279* (2013.01); *B01L 3/0237* (2013.01); *B01L 2200/0605* (2013.01); *B01L 2300/025* (2013.01); *B01L 2300/027* (2013.01); *B01L 2300/0627* (2013.01); *B01L 2400/0478* (2013.01)

(58) Field of Classification Search
None
See application file for complete search history.

(56) References Cited

U.S. PATENT DOCUMENTS

| | | | |
|---|---|---|---|
| 4,406,170 | A | 9/1983 | Kuhn |
| 4,567,780 | A | 2/1986 | Oppenlander |
| 4,821,586 | A | 4/1989 | Scordato |
| 5,271,527 | A | 12/1993 | Haber |
| 5,591,408 | A | 1/1997 | Belgardt et al. |

(Continued)

FOREIGN PATENT DOCUMENTS

| | | | |
|---|---|---|---|
| CA | 2126934 | C | 10/2005 |
| CN | 103372472 | A | 10/2013 |

(Continued)

*Primary Examiner* — Brian R Gordon
(74) *Attorney, Agent, or Firm* — Vidas, Arrett & Steinkraus, PA; Richard A. Arrett; Edwin E. Voigt, II

(57) ABSTRACT

A pipette with an adjustable dosing increment, wherein a control apparatus determines a dosing volume by a set dosing increment when a syringe is inserted in the pipette, and determines a maximum possible number of dosing steps following an execution of a reverse stroke without refilling the syringe given the set dosing increment and completely or partially filled syringe by the position of a displacement means on the path, and displays the maximum number of dosing steps on a display apparatus until the reverse stroke is executed. The control apparatus also determines the number of executed dosing steps and displays the number of executed dosing steps and/or the number of dosing steps still possible without refilling the syringe on the display apparatus.

4 Claims, 8 Drawing Sheets

(56) References Cited

U.S. PATENT DOCUMENTS

| | | | | |
|---|---|---|---|---|
| 5,620,660 | A | 4/1997 | Belgardt et al. | |
| 5,620,661 | A | 4/1997 | Schurbrock | |
| 6,170,343 | B1 | 1/2001 | Conley | |
| 7,731,908 | B2 | 6/2010 | Lenz | |
| 9,291,529 | B2 | 3/2016 | Lohn | |
| 10,184,107 | B2 | 1/2019 | Peng | |
| 2001/0019701 | A1* | 9/2001 | Braun | G01N 35/00732 422/63 |
| 2004/0057875 | A1 | 3/2004 | Bigus | |
| 2005/0118069 | A1* | 6/2005 | Solotareff | B01L 3/0237 436/180 |
| 2005/0142038 | A1 | 6/2005 | Petrek | |
| 2007/0203457 | A1* | 8/2007 | Kohn | G01N 31/18 604/189 |
| 2007/0227271 | A1 | 10/2007 | Curtis | |
| 2007/0276546 | A1 | 11/2007 | Molitor | |
| 2007/0283743 | A1 | 12/2007 | Telimaa | |
| 2008/0193335 | A1 | 8/2008 | Czernecki | |
| 2008/0210023 | A1 | 9/2008 | Telimaa | |
| 2009/0000035 | A1 | 1/2009 | Magnussen | |
| 2009/0071266 | A1 | 3/2009 | Nelson | |
| 2009/0074622 | A1 | 3/2009 | Kalamakis | |
| 2009/0117008 | A1 | 5/2009 | Ling | |
| 2010/0266454 | A1 | 10/2010 | Reichmuth | |
| 2011/0033349 | A1 | 2/2011 | Schmidt | |
| 2011/0181272 | A1 | 7/2011 | Andres | |
| 2012/0046883 | A1 | 2/2012 | Ayliffe | |
| 2012/0148459 | A1 | 6/2012 | Sama | |
| 2012/0291567 | A1 | 11/2012 | Homberg | |
| 2013/0095508 | A1 | 4/2013 | Campitelli | |
| 2013/0255404 | A1 | 10/2013 | Mohr | |
| 2013/0267038 | A1 | 10/2013 | Andersin | |
| 2013/0288382 | A1* | 10/2013 | Andres | B01L 3/021 436/180 |
| 2013/0319139 | A1 | 12/2013 | Belgardt | |
| 2014/0010731 | A1 | 1/2014 | Belgardt et al. | |
| 2014/0010732 | A1 | 1/2014 | Belgardt | |
| 2014/0047931 | A1 | 2/2014 | Mettier | |
| 2014/0051182 | A1* | 2/2014 | Reichmuth | B01L 3/0237 436/180 |
| 2014/0130614 | A1 | 5/2014 | Zeng | |
| 2014/0331794 | A1 | 11/2014 | Berghall | |
| 2014/0334993 | A1 | 11/2014 | Berghall | |
| 2015/0000429 | A1 | 1/2015 | Lind | |
| 2015/0030513 | A1 | 1/2015 | Butz | |
| 2016/0236189 | A1* | 8/2016 | Izumo | G01F 25/0084 |
| 2016/0310937 | A1* | 10/2016 | Lind | B01L 3/0227 |
| 2017/0108521 | A1* | 4/2017 | Sasaki | B25J 11/00 |
| 2017/0151556 | A1 | 6/2017 | Wilth | |
| 2017/0173576 | A1* | 6/2017 | Natsume | G01N 35/1011 |
| 2017/0274372 | A1* | 9/2017 | Katano | G01N 35/1011 |

FOREIGN PATENT DOCUMENTS

| | | | |
|---|---|---|---|
| DE | 4437716 | C2 | 10/1996 |
| EP | 0562229 | A2 | 9/1993 |
| EP | 0656229 | A1 | 6/1995 |
| EP | 0657216 | A1 | 6/1995 |
| EP | 0679439 | A1 | 11/1995 |
| EP | 1724020 | A1 | 11/2006 |
| EP | 2574402 | A1 | 4/2013 |
| EP | 2656916 | A1 | 10/2013 |
| EP | 2783753 | A1 | 10/2014 |

* cited by examiner

METHOD FOR DOSING LIQUID BY MEANS OF A PIPETTE AND A SYRINGE, AND PIPETTE FOR ACTUATING A SYRINGE FOR DOSING LIQUID

CROSS-REFERENCE TO RELATED APPLICATIONS

This application is a divisional of application Ser. No. 15/844,921 filed Dec. 18, 2017, which issued Oct. 26, 2021 as U.S. Ser. No. 11/154,854, the entire contents of which is hereby incorporated by reference.

FIELD OF THE INVENTION

The invention relates to a method for dosing liquid by means of a pipette and a syringe, and a pipette for actuating a syringe for dosing liquid.

DESCRIPTION OF THE RELATED ART

The pipettes at issue here for actuating a syringe serve to dispense the liquid drawn into the syringe in several steps. They are also termed dispensers or repeating pipettes. At the bottom end of a rod-shaped housing, these pipettes have a seat for a flange of a syringe cylinder and, in the housing, have a displaceable seat body with a plunger seat for the top end region of a plunger rod of a syringe plunger. The syringe can be inserted with the flange and the end region of the plunger rod through axially-aligned openings in the seats. The flange and the end region are held in the seats by means for releasably holding that, for example, are designed as spring-loaded gripping levers. Furthermore, the pipette has means for displacing the seat body that make it possible to partially remove the plunger from the cylinder to draw liquid into the syringe, and press the plunger stepwise into the cylinder for the stepwise dispensing of liquid.

DE 29 26 691 C2 and U.S. Pat. No. 4,406,170 A, both of which are hereby incorporated by reference in their entirety, describe means for displacing the seat body in the housing. These comprise a drawing lever that is connected to the seat body and projects out of the housing through a straight slot for drawing liquid into the syringe by displacing the seat body away from the seat. Furthermore, it comprises a toothed rack and pawl apparatus for moving the plunger in steps by a dosing lever that can be displaced back and forth. A pivotable pawl is mounted on the dosing lever. The toothed rack is connected to the seat body and is arranged within the pivot range of the pawl. An adjustably movable cover more or less covers the row of teeth on the toothed rack to limit the engagement of the pawl in the toothed rack when pivoting the dosing lever.

Moreover, the toothed rack is designed with a contour by means of which the cover can be displaced away from the toothed rack when the plunger is in an advanced position so that it prevents the pawl from engaging in uncovered teeth of the toothed rack. This prevents a residual amount from being dispensed from the syringe that is less than the metered quantity to be dispensed in each metering step.

Developments of the means for releasably holding the syringe are described in EP 0 656 229 B1 and U.S. Pat. No. 5,620,660A. EP 1 724 020 B1 and U.S. Pat. No. 7,731,908 B2 describe a development of the holding devices that make it possible to release the syringe from the pipette by single-hand actuation.

EP 0 657 216 B1 and U.S. Pat. No. 5,620,661A describe such a pipette with a sensor for sensing elevations and recesses on the syringe flange and associated syringes. The sensor serves to determine the size of the inserted syringe. Electronics determine the amount of the liquid dispensed in each dispensing step based on the set increment. This is shown on a display.

EP 2 574 402 B1 and U.S. Pat. No. 9,291,529 B2 describe a development of syringe recognition in which the syringe, in addition to the coding elements of the coding, have test elements, and the coding elements together with the test elements have a total of six elevations, as well as a dosing mechanism with a scanning device for scanning the recording elements and test elements, and an associated evaluation apparatus. In the developed syringe recognition, the risk of incorrect doses is further reduced.

Developments of the means for displacing the seat body are described in DE 4 437 716 C2, EP 0 679 439 B1 and U.S. Pat. No. 5,591,408A. According to EP 0 679 439 B1 and U.S. Pat. No. 5,591,408A, the repeating pipette has a constant increment apparatus that sets a constant value for the length of the first increment for moving the seat body for the actuating section of the syringe plunger toward the cylinder seat for the syringe cylinder, the value being independent of the setting of the following increments. Play between the pipette and syringe which impairs the dosing precision is overcome by means of this constant reverse stroke when the seat body is displaced back toward the cylinder seat after drawing liquid.

EP 2 656 916 A1 describes a method for dosing liquid by means of a pipette and a syringe, and a pipette for actuating a syringe for dosing liquid. In this development, the completely filled syringe with the set dosing increment displays the maximum possible number of dosing steps by means of a pipette display apparatus without refilling the syringe. After the reverse stroke, the executed dosing steps are counted, and/or the number of the still possible dosing steps without refilling the syringe is determined and displayed with the display apparatus. If, after the maximum number of dosing steps have been performed, the syringe is refilled and additional dosing steps are performed, the total dosing steps executed with the syringe with the set dosing increment are counted, and the number of the still possible dosing steps without refilling the syringe is determined and displayed. If the syringe is removed from the pipette and replaced with a new syringe, the executed dosing steps are counted from the beginning, and/or the still possible dosing steps without refilling are determined and displayed. By a flashing display or display that otherwise indicates the ongoing process of drawing liquid into the syringe and performing a reverse stroke, the user is instructed to fill the syringe completely with liquid when possible and perform the reverse stroke. If the dosing steps are performed after incompletely drawing liquid into the syringe, the display apparatus of the pipette displays a display indicating the performance of a reverse stroke until the reverse stroke is executed by one or more dosing steps, and the subsequent dosing steps are counted and displayed by the display apparatus. According to one exemplary embodiment, when the syringe is partially filled, the user is shown by a flashing display that it is uncertain that the displayed maximum number of dosing steps for a complete filling will be achieved. The flashing only stops when the user has performed a sufficient number of dosing steps that corresponded to a reverse stroke. This shows the user that the dosing was imprecise and he should discard the dispensed dosed amounts. Once the reverse stroke has been executed, the control apparatus indicates the set dosing volume by the display apparatus, and the number of performed dosing steps. However, the display continues to count even after using the residual travel block so that the user does not know how many dosing steps with the correct volume were actually dispensed.

The entire contents of all of the references discussed above are each hereby incorporated by reference in their entirety

BRIEF SUMMARY OF THE INVENTION

Accordingly, when the syringe is partially filled, the user does not learn the maximum number of dosing steps possible without refilling the syringe. The display of the possible maximum number of dosing steps can only be ensured by completely filling the syringe.

Against this background, the object of the invention is to provide a method for dosing liquid by means of a pipette and a syringe, and a pipette for actuating a syringe for dosing liquid that enables the user to ensure that the maximum possible number of dosing steps are displayed even when the syringe is partially filled.

The object is achieved by the inventive method.

Advantageous embodiments of the method are cited in the dependent claims.

The method for dosing liquid by means of a pipette with an adjustable dosing increment, a display apparatus, a drawing lever to draw liquid into a syringe, and a control button to discharge liquid in steps from the syringe, and the syringe actuated by means of the pipette, comprises the following steps:

1.1. The syringe is releasably connected to the pipette, 1.2. The dosing increment is optionally set, or the previously set dosing increment is retained, 1.3. The dosing volume set by the dosing increment is displayed by means of the display apparatus, 1.4. Liquid is sucked into the syringe by actuating the drawing lever, 1.5. The respective position of a drive element of a drive mechanism of the pipette for filling and draining the syringe when the drive element is displaced along a path is detected, 1.6. The possible maximum number of dosing steps with the set dosing increment without refilling the syringe after executing the reverse stroke starting from the position of the drive element reached at the end of filling is displayed by means of the display apparatus, 1.7. After the syringe is completely or partially filled with liquid, the reverse stroke is executed by actuating the control button at least once, 1.8. Dosing steps are executed by actuating the dosing button, the executed dosing steps are counted, the number of executed dosing steps and/or the number of still possible dosing steps without refilling the syringe are determined and displayed by means of the display apparatus, and 1.9. After executing the maximum possible number of dosing steps without refilling the syringe, either the syringe is removed from the pipette, or steps 1.2 to 1.8 are repeated with same syringe, wherein in step 1.8, the total number of dosing steps performed with the syringe with the set dosing increment is counted, and/or the number of still possible dosing steps without refilling the syringe is determined and displayed by means of the display apparatus.

In the method according to the invention, the possible maximum number of dosing steps without refilling the syringe when the syringe is partially filled is determined with the assistance of the detected position of the drive element on the path at the end of filling the syringe. The path is straight when the drive element is designed as a toothed rack. When the maximum number of dosing steps is determined, the set dosing increment and the reverse stroke to be executed are taken into consideration. The reverse stroke to be executed is preferably a fixed value that is fixed so that the play between the pipette and syringe is overcome when performing the reverse stroke. Since the constant increment apparatus according to the aforementioned prior art only works when the syringe is completely full, the reverse stroke to be executed is preferably executed by executing one or more dosing steps by pressing the control button at least once. The number of actuations of the control button for executing the reverse stroke depends upon the set dosing increment. An actuation of the control button is understood to be a complete displacement of the control button from a specific initial position into a specific end position that for example are defined by stops or increasing resistance against further displacement beyond the respective starting or end position.

According to a design of the method, the respective position of a drive element while being displaced along a path is detected by an incremental encoder arranged on a displacement element of a means for displacing a piston in a cylinder of the syringe, and by means of at least one sensor fixedly arranged in a housing of the pipette with respect to the displacement element. According to another embodiment, the incremental encoder is an optical scale or magnetic strip, and the sensor is a light barrier or a magnetic sensor. According to another embodiment, the position of the drive element is detected by means of a capacitive sensor that has at least one first capacitor plate arranged on a displacement element of the displacing means, and at least one second condenser plate fixedly arranged in the housing. According to another embodiment, the displacement element is a toothed rack, and the incremental encoder is designed as a single piece with the toothed rack, or is a component securely connected to the toothed rack. According to another embodiment, the incremental encoder is formed by the teeth of the toothed rack.

According to another embodiment, the incremental encoder is adhered to the displacement element, injection molded therein, or imprinted therein. According to another embodiment, the position of the drive element is detected by a rotary encoder that is coupled by a gear drive or another gear unit to the displacement element.

According to another embodiment of the invention, when the syringe is completely filled, the possible maximum number of dosing steps without refilling the syringe is determined as if the syringe were partially filled. The reverse stroke can also be executed as with partial filling by actuating the dosing button one or more times depending on the set dosing increment. When the syringe is completely filled, the displacement of the drive element and reverse stroke to be executed are known. Consequently according to another embodiment, the maximum number of dosing steps possible without refilling the syringe is determined with the assistance of the set dosing increment, the known displacement of the drive element when the syringe is completely full, and the reverse stroke to be executed. The displacement of the drive element in the event of complete filling is for example defined by a start position and an end position between which the drive element is displaced along the path in the event of complete filling. According to another embodiment, when the syringe is completely filled, the reverse stroke is executed by means of a constant increment apparatus according to the aforementioned prior art. Alternatively, the reverse stroke is performed when the syringe is completely and partially filled by means of a constant increment apparatus that works when the syringe is completely and partially filled.

After the reverse stroke to be executed, the user can execute dosing steps by actuating the control button. In a known manner, the executed dosing steps are counted, the number of executed dosing steps and/or the number of still possible dosing steps without refilling the syringe are determined and displayed by means of the display apparatus. Continuing to work with the same syringe or a new syringe after executing the possible maximum number of dosing steps without refilling the syringe also corresponds to the known method.

In a preferred embodiment of the invention, the number of actuations of the control button for the reverse stroke to be executed for the set dosing increment is determined, and the pipette outputs a display, and/or signal, and/or other output indicating the execution of the required number of actuations until the reverse stroke to be executed is performed, and/or if the reverse stroke to be executed is executed. This instructs the user to actuate the control button until the reverse stroke to be executed is fully executed. The output can continue until the reverse stroke to be executed has been executed, or only when the reverse stroke to be executed has been executed. Combinations are also possible, wherein preferably the output is different before execution of the reverse stroke to be executed than after execution of the reverse stroke to be executed. Alternatively, the user can see in a table the number of actuations of the control button that are necessary at which set dosing increment so that the reverse stroke to be executed is executed.

According to another embodiment, after the syringe is releasably connected to the pipette before termination of filling of the syringe with liquid, the maximum possible number of dosing steps with the set dosing increment and a completely filled syringe after execution of the reverse stroke without refilling the syringe is displayed by the display apparatus. When the user has completely filled the syringe, he can execute these displayed maximum possible number of dosing steps without refilling the syringe. When the user stops filling the syringe before the syringe is completely filled, the maximum possible number of dosing steps without refilling the syringe when the syringe is partially filled is displayed. According to another embodiment, the user has the option of still filling the syringe when the maximum possible number of dosing steps displayed in the event of partial filling is insufficient. According to another embodiment, the user can only execute the maximum possible number of dosing steps without refilling the syringe in the event of partial filling, or drain the syringe using the discharge lever and then refill the syringe.

According to another embodiment, the termination of filling the syringe is recognized when the displacement of the drive element has stopped, and/or the direction of displacement of the drive element is reversed. According to another embodiment, continued filling of the syringe without prior drainage is possible in the first variation, and additional filling of the syringe is not possible without prior drainage of the syringe in the second version.

According to another embodiment, a display, signal or other output indicating the ongoing process of drawing liquid into the syringe and performing the reverse stroke can be output by the display apparatus, and/or by another output apparatus of the pipette while suctioning liquid by actuating the drawing lever until executing the reverse stroke by actuating the control button, and the aforementioned output is not output before suctioning liquid and after executing the reverse stroke. According to another embodiment, the display is an arrow pointing upward or another obvious icon displayed while drawing. According to another embodiment, the display is an arrow pointing upward that rolls or flashes while drawing. According to another embodiment, the display is an arrow pointing downward that rolls or flashes after the syringe is completely filled. This makes it easier to operate the pipette.

According to another embodiment, a display is only displayed by the display apparatus when a syringe is releasably connected to the pipette, and the display disappears when the syringe is disconnected from the pipette. This reduces the power consumption of the pipette, and a battery or another power source is spared.

According to another embodiment, the display apparatus shows the maximum possible number of dosing steps with the reset dosing increment without refilling the syringe and the dosing volume set by the reset dosing increment when the dosing increment is reset after executing the reverse stroke and before executing the maximum possible number of dosing steps without refilling the syringe. This allows dosing procedures to be more flexible. The display of the maximum possible number of dosing steps without refilling the syringe is first enabled when the dosing increment is reset after partially filling the syringe.

According to another embodiment, when a dosing step has been incompletely executed, the pipette outputs a display, signal, or other information by the display apparatus or another display apparatus indicating the incompletely executed dosing step, and/or the number of completely discharged dosing steps, and/or the still possible number of dosing steps without refilling the syringe. An incompletely executed dosing step results from improperly actuating the control button so that it does not move from the start position to the end position. It can occur by incorrectly operating the control button, or by accidentally actuating the control button.

According to another embodiment, the number of performed dosing steps is not counted after an incompletely executed dosing step until the syringe is completely drained or until a complete dosing step has been executed, and the pipette outputs a display, signal or other information by means of the display apparatus or another display apparatus indicating the incomplete discharge of liquid until the syringe is completely drained or a complete dosing step has been executed. In this embodiment, either the syringe must be completely drained after an incompletely executed dosing step so that additional dosing steps are possible which are counted, or a complete dosing step must first be executed so that other dosing steps can be performed and counted. To perform a complete dosing step, the user must reactuate the control button after the incorrect dosing, possibly several times, for example until the pawl of a toothed rack/pawl arrangement engages in the toothed rack for optimally displacing the plunger of the syringe.

According to another embodiment, the amount of liquid drawn while filling the syringe is determined with reference to the detected position of the drive element on the path, and is displayed by means of the display apparatus. This allows the user to easily determine the amount of liquid drawn when the syringe is partially or completely filled. This embodiment allows the volume of the drawn amount of liquid to be measured online. According to another embodiment, the drawn amount of liquid is continuously displayed while filling the syringe. According to another embodiment, the drawn amount of liquid is displayed after filling the syringe has terminated. The termination of filling the syringe is recognized when the displacement of the drive element has stopped, and/or the direction of displacement of the drive element is reversed.

According to another embodiment, the entire amount of drawn liquid yet be discharged after executing the reverse stroke is displayed in addition to the drawn amount of liquid. According to another embodiment, the entire amount of liquid to be discharged after execution of the reverse stroke is continuously displayed while filling the syringe with liquid, and/or after terminating filling the syringe with liquid. This embodiment makes it possible to measure on line the volume of the part of the drawn amount of liquid available for dispensing precise dosing volumes in several steps.

According to another embodiment, the display of the drawn amount of liquid and/or the display of the amount of liquid available for dispensing after executing the reverse stroke can be switched on and off. According to another embodiment, the drawn amount of liquid is discharged in a single dosing step, or in a plurality of dosing steps.

According to another embodiment, the drawn amount of liquid is discharged by actuating the drawing lever in the direction opposite its actuation while filling the syringe. This allows an amount of liquid to be transferred, or respectively the volume of an amount of liquid to be measured. The amount of liquid can be discharged without a reverse stroke. It can occur in a single step.

According to another embodiment, the pipette detects a code indicating a syringe volume of the syringe connected to the pipette and determines the dosing volume based on the set dose increment and the detected code, and shows the dosing volume by means of the display apparatus. This embodiment makes it possible to use different sized syringes, wherein the dosing volume is always automatically displayed which is discharged by the employed syringe with the set dosing increment.

According to another embodiment of the method, the pipette has at least one additional feature of the pipette described below and its embodiments.

The pipette according to the invention for handling a syringe comprises:

A rod-shaped housing, a seat with an opening at the bottom end of the housing for inserting a syringe with a fastening section at the top edge of a cylinder, a seat body with another seat and another opening at the bottom end in the housing for inserting another fastening section of a plunger of the syringe, means for releasably holding the fastening section in the seat and the additional fastening section in the additional seat, at least one means for displacing the seat body within the housing in the longitudinal direction of the housing, the drawing lever that can be actuated outside of the housing for drawing liquid into the syringe, a control button that can be actuated outside of the housing for the stepwise discharging of liquid from the syringe, and an adjusting element for adjusting a dosing increment that can be adjusted outside of the housing, means for detecting the dosing increment set with the adjusting element, means for detecting a syringe releasably connected to the pipette, means for detecting the respective position of the means for displacing the seat body when displacing the displacement means along a path relative to the housing, an electronic control apparatus connected to the detection means, and an electronic display apparatus connected to the electronic control apparatus, wherein the control apparatus is configured so that it determines the dosing volume by the set dosing increment when the syringe is inserted in the pipette, and determines the maximum possible number of dosing steps without refilling the syringe given the set dosing increment and completely or partially filled syringe by the position of the displacement means on the path, and displays them by the display apparatus, it determines the execution of a reverse stroke to be executed by at least once actuating the control button, and outputs output indicating this by means of the display apparatus or another display apparatus until the reverse stroke is executed and/or after execution of the reverse stroke, and it determines the number of executed dosing steps and displays the number of executed dosing steps and/or the number of dosing steps still possible without refilling the syringe by means of the display apparatus.

The means for detecting a syringe releasably connected to the pipette signal to the control apparatus that a syringe is inserted. Then the control apparatus determines the maximum number of dosing steps that is possible without refilling the syringe after completely or partially filling the syringe by the detected dosing increment and data on the inserted syringe available in the control apparatus. When determining the maximum possible number of dosing steps without refilling the syringe, the control apparatus takes into account the position of the displacement means on the path detected by the means for detecting the respective position of the displacement means of the drawing body. When the syringe is completely filled, the control apparatus can, in one embodiment, use a fixed value for displacing the drive element that, for example, is saved, instead of the detected position. By means of the display apparatus, the control apparatus displays the dosing volume detected from the dosing increment and the determined maximum number of dosing steps. When dosings occur, this can be indicated to the control apparatus by the means for detecting the position that detect the position of the means for displacing the seat body on the path. According to an alternative embodiment, means exist for this for detecting the performance of a dosing step by actuating the control button, such as sensors or pushbuttons that emit a signal upon each actuation of the control button. Accordingly, the user is informed about the set dosing volume, the maximum possible number of dosing steps when the syringe is completely or partially filled, and the executed number of dosing steps, and/or the dosing steps still possible without refilling. According to a variation, the control apparatus is configured so that the number of executed dosing steps is displayed, and the number of dosing steps still possible without refilling the syringe is not displayed. According to another variation, the control apparatus is configured so that the number of dosing steps still possible without refilling the syringe is displayed instead of the number of executed dosing steps. According to an additional variation, the control apparatus is configured so that the number of executed dosing steps and the number of dosing steps still possible without refilling the syringe are displayed.

According to another embodiment, the means for detecting the respective position of the displacement means has an incremental encoder arranged on the displacement element of the displacement means (such as an optical scale or magnetic strip) and at least one sensor fixedly arranged in the housing and connected to the control apparatus (such as a light barrier or magnetic sensor) for detecting the displacement of the displacement element. By means of the incremental encoder, the displacement of the displacement element can be detected very easily and precisely. Suitable incremental encoders and sensors are available as prefabricated systems.

The systems are capable of detecting and indicating the movements of the incremental encoder in different directions. The segmentation of the incremental encoder can be selected corresponding to the precision requirements for drawing liquid and dispensing liquid. According to a preferred embodiment, the segmentation is selected from the range of 0.1 to 0.5 mm. It is for example 0.1 mm, 0.25 mm or 0.5 mm.

According to another embodiment, the means for detecting the respective position of the displacement means have a capacitive sensor. According to another embodiment, the capacitive sensor has at least one first capacitor plate arranged on a displacement element of the displacement means, and at least one second capacitor plate fixedly arranged in the housing, wherein the first and second capacitor plate are connected to the control apparatus, and the control apparatus determine the capacitance between the first and second capacitor plates. The capacitance between the first and second capacitor plates is a measure of the overlap between the first and second plates and hence the respective position of the displacement means. The capacitive sensor is for example designed as described in CA 2,126,934C (page 10, lines 3 to 26) whose content is hereby incorporated in the present application.

According to another embodiment, the displacement element is a toothed rack whose bottom end is connected to the drawing body that can be engaged with a pawl pivotably mounted on the control button when the control button is actuated to displace the toothed rack a dosing step when the control button is actuated. Such apparatuses with a toothed rack and a pawl are described in the aforementioned prior art.

According to a preferred embodiment, the incremental encoder is designed as a single piece with the toothed rack, or is a component securely connected to the toothed rack. The incremental encoder can also be formed by the teeth of the toothed rack. According to another embodiment, the incremental encoder is formed on a different side of the toothed rack than the teeth. According to another embodiment, the incremental encoder is adhered to the displacement element, injection molded therein, or imprinted therein. According to another embodiment, the means for detecting a displacement comprise a rotary encoder that is coupled by a gear drive or another gear unit to the displacement element, and whose sensor is connected to the control apparatus.

According to another embodiment, the pipette does not have any separate sensors for detecting the bottom-most and topmost position of the toothed rack. In this embodiment, the bottom and top end positions which are designated by reference signs 81 and 67 in the patent application EP 2 656 916 A1 are omitted. Instead, the respective position of the toothed rack including the bottom and top end positions are detected by the incremental encoder. The top and bottom end position can, if applicable, be marked by means of special marks on the incremental encoder, such as by a particularly wide scale line of an optical scale, or by sequential like poles of a magnetic strip. When the sensors for the bottom and top end position are omitted, it can be useful to teach the pipette during installation, i.e., precisely establish where the top and bottom end position are. For this, a first scale line or a first group of scale lines can be assigned to the bottom end position, and a second scale line or a second group of scale lines can be assigned to the top end position. When the teaching function is used, a separate marking of the toothed rack can be entirely omitted, if applicable, by using the teaching function to assign the bottom end position to a first tooth or a first group of teeth, or to assign the top end position to a second group of teeth tooth or a second group of teeth of the toothed rack.

According to another embodiment, the control apparatus is configured so that it determines the total number of dosing steps performed with the syringe with the set dosing increment after performing the maximum number of dosing steps and refilling the same syringe, and/or displays the number of dosing steps still possible without refilling the syringe and displays them with the display apparatus. According to another embodiment, the control apparatus is configured so that it again determines the number of executed dosing steps each time a syringe is used.

According to another embodiment, the control apparatus is configured so that, after the syringe is releasably connected to the pipette and before termination of filling of the syringe with liquid, it displays with the display apparatus the maximum possible number of dosing steps with the set dosing increment and a completely filled syringe without refilling the syringe.

According to another embodiment, the control apparatus is configured so that it recognizes the termination of filling the syringe when the displacement of the drive element has stopped, and/or the direction of displacement of the drive element is reversed.

According to another embodiment, the control apparatus is configured so that a display, signal or other output by the display apparatus, and/or by another output apparatus of the pipette is output indicating the ongoing process of drawing liquid into the syringe and performing the reverse stroke, while suctioning liquid by actuating the drawing lever until executing the reverse stroke by actuating the control button, and the output is not output before suctioning liquid and after executing the reverse stroke.

According to another embodiment, the control apparatus is configured so that a display is only shown by the display apparatus when a syringe is releasably connected to the pipette, and the display disappears when the syringe is disconnected from the pipette.

According to another embodiment, the control apparatus is configured so that the display apparatus shows the maximum possible number of dosing steps with the reset dosing increment without refilling the syringe and the dosing volume set by the reset dosing increment when the dosing increment is reset after executing the reverse stroke and before executing the maximum possible number of dosing steps without refilling the syringe.

According to another embodiment, the control apparatus is configured so that when a dosing step has been incompletely executed, the pipette outputs a display, signal, or other information by the display apparatus or another display apparatus indicating the incompletely executed dosing step, and/or the number of completely discharged dosing steps, and/or the still possible number of dosing steps without refilling the syringe.

According to another embodiment, the control apparatus is configured so that the number of performed dosing steps is not counted after an incompletely executed dosing step until the syringe is completely drained or until a complete dosing step has been executed, and the pipette outputs a display, signal or other information by means of the display apparatus or another display apparatus indicating the incomplete discharge of liquid until the syringe is completely drained or a complete dosing step has been executed.

According to another embodiment, the pipette has a sensor for detecting a code indicating a syringe volume on a syringe releasably connected to the pipette. This makes it possible to use the pipette with syringes that have different volumes, wherein the control apparatus always determines the set dosing volume by the set dosing increment and the determined syringe volume and displays them on the display apparatus. The sensor is preferably a ring sensor. According to a preferred embodiment, the sensor for detecting a code is simultaneously the means for detecting a syringe releasably connected to the pipette.

According to another embodiment, the control apparatus is configured so that the amount of liquid drawn while filling the syringe is determined with reference to the detected position of the drive element on the path, and is displayed by means of the display apparatus.

According to another embodiment, the control apparatus is configured so that the dosing volume is determined by the set dosing increment and the detected code of a syringe held by the pipette, and is displayed by means of the display apparatus.

According to another embodiment, the pipette is designed to execute the method described on pages 5 to 13 of the description. According to a preferred embodiment, the control apparatus is designed to process the signals provided by the detection means and to control the display apparatus and an optional additional output apparatus corresponding to the method according to one of the additional embodiments.

According to another embodiment, the pipette is a pipette driven by the muscular force of the user. According to another embodiment, the pipette has mechanical drive apparatuses for driving the seat body that are driven by the muscular force of the user.

The means for holding the fastening section in the seat and the other fastening section in the other seat are preferably designed as described in the aforementioned documents from the prior art. The means for displacing the seat body within the housing are preferably designed as described in the aforementioned documents from the prior art. The sensor for detecting a code of the syringe and the code of the syringe are preferably designed as described in the aforementioned documents from the prior art. In this regard, reference is made to the aforementioned documents DE 29 26 691 C2, U.S. Pat. No. 4,406,170 A, DE 4 437 716 C2, EP 0 679 439 B1, U.S. Pat. No. 5,591,408 A, EP 0 562 229 B1, U.S. Pat. No. 5,620,660 A, EP 1 724 020 B1, U.S. Pat. No. 7,731,708 B2, EP 0 657 216 B1, U.S. Pat. No. 5,620,661 A, EP 2 574 402 B1 and U.S. Pat. No. 9,291,529 B2, the content of which is hereby incorporated in the present application.

In the present application, "the dosing amount" or "amount of liquid that is discharged, or respectively to be discharged" are used as synonyms for the term "dosing volume". Moreover, "dispensing volume" is used instead of the aforementioned terms, provided that dispensing occurs in several steps.

BRIEF DESCRIPTION OF THE SEVERAL VIEWS OF THE DRAWINGS

The invention is explained in greater detail below based on the appended drawings of an exemplary embodiment. In the drawings.

DETAILED DESCRIPTION OF THE INVENTION

In the present application, the designations "top" and "bottom" refer to the alignment of the pipette in which the rod-shaped housing is aligned vertically, and the seat for the syringe is arranged at the bottom.

Figure 1:
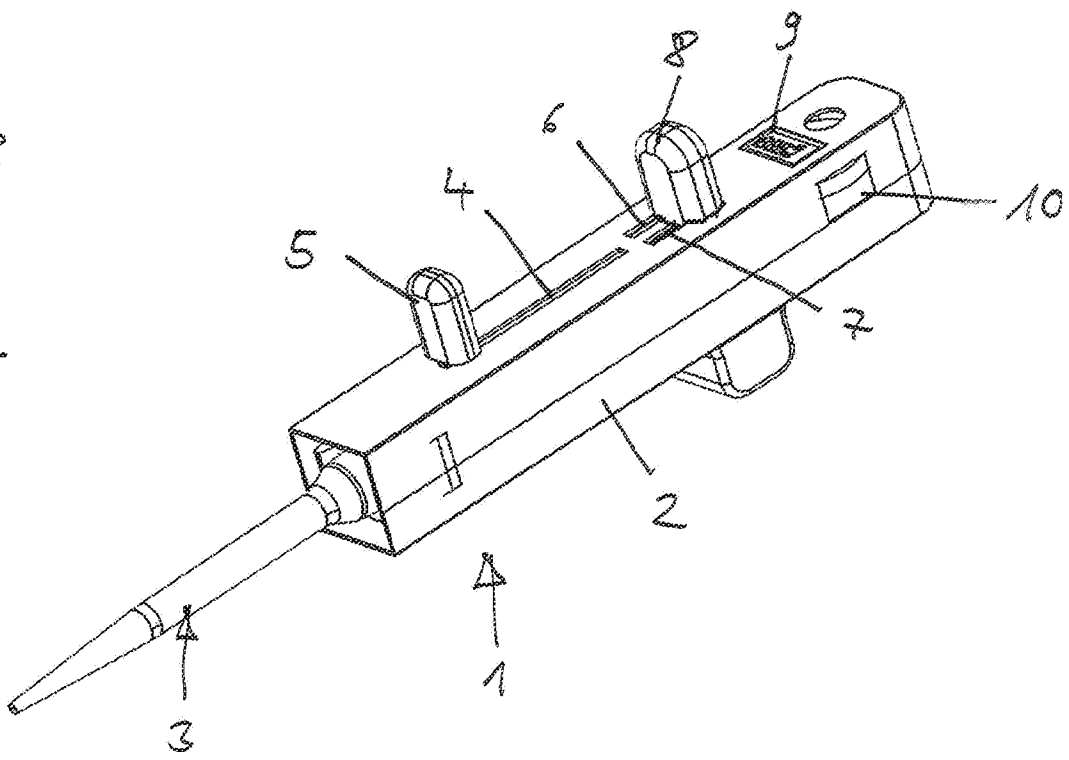
FIG. 1 shows a pipette according to the invention with a syringe held therein in a perspective view from the side.
Figure 3:
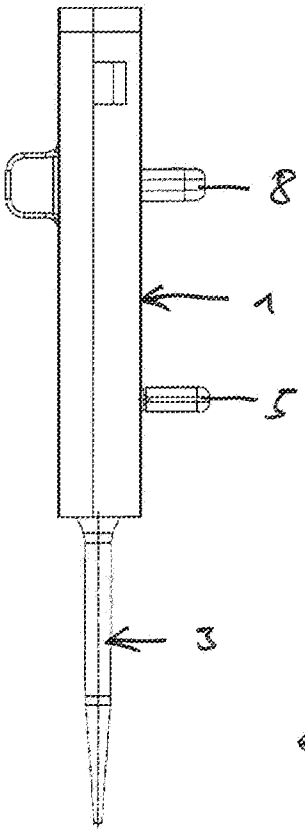
FIG. 3 shows the same pipette with the syringe held therein in a side view.
Figure 2:
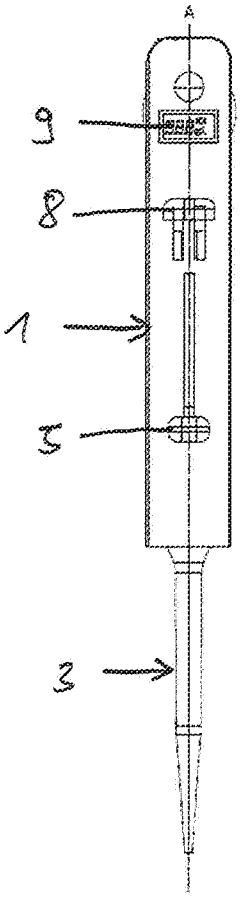
FIG. 2 shows the same pipette with the syringe held therein in a front view.

According to FIGS. 1 to 3, a pipette 1 has a rod-shaped housing 2 in which a syringe 3 is held at the bottom. A drawing lever 5 projects from the housing 2 from a sidewall of the housing 2 over a straight slot 4. A control button 8 of a toothed rack/pawl control projects from the same side wall of the housing above two additional slots 6, 7. Above that, a display apparatus in the form of an LCD display 9 is recessed in the same side wall of the housing 2. Segments of a selection wheel 10 project from openings in the adjacent sidewalls.

Figure 4:
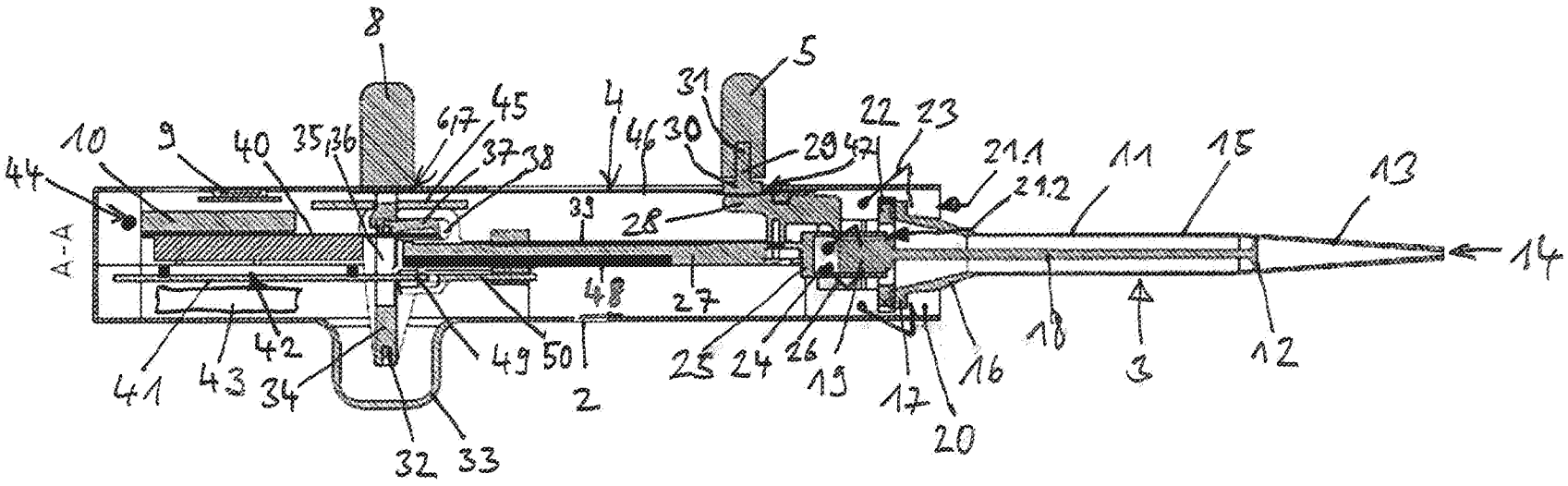
FIG. 4 shows the same pipette with the syringe held therein in a longitudinal section.

According to FIG. 4, the syringe 3 has a cylinder 11 and a plunger 12 movably arranged therein. The cylinder 11 has a conical section 13 at the bottom with a hole 14 for the passage of liquid, and a cylindrical section 15 above that in which the plunger 12 can be displaced. At the top, the cylinder 11 has a fastening section 16 with a peripheral flange 17. From the plunger 12, a plunger rod 18 projects upward and has another fastening section 19 with a plurality of peripheral beads.

The syringe 3 is arranged with the flange 17 in a seat 20 on the bottom end of the housing 2 that has an axially directed opening 21.1 in the bottom end of the housing 2 for inserting and removing the syringe 3. The syringe 3 presses with its top side against a pressure sensitive ring sensor 22 that senses the projections on the top edge of the flange 17. The flange is 17 is held in this position by gripping levers 23 in the housing 2.

The additional fastening section 19 of the plunger 12 is arranged in an additional seat 24 in a hollow cylindrical seat body 25. This has another axially directed opening 21.2 for inserting the additional fastening section 19. The additional fastening section 19 is held by additional gripping levers 26 that engage between the beads of the additional fastening section 19 or clamp them.

The seat body 25 is securely connected to a toothed rack 27 that extends below the slot 4 in the longitudinal direction of the housing 2.

A drawing lever holder 28 is fixed to the seat body 25 and the bottom part of the toothed rack 27.

Furthermore, there is a drawing lever support 29 30 that lies with a slide plate against the bottom side of the edges of the slot 4. The slide plate 30 has a spike 31 that projects upward and penetrates the slot 4. The drawing lever 5 is fixed to the spike 31 outside of the housing 2.

In the upper half of the housing 2, a dosing lever 34 is pivotably mounted in a pivot bearing 32 in a bulge 33 in the side wall of the housing 2 opposite the slot 4. The dosing lever 34 has two legs 35, 36 at a distance from each other that extend on the opposite side wall of the housing 2 out of the two slots 6, 7. The control button 8 is fixed on the ends of the legs 35, 36 extending out of the housing 2.

A pawl 37 is pivotably mounted between the two legs 35, 36 of the dosing lever 34. The pawl 37 is arranged with a pawl tooth 38 above the teeth 39 of the toothed rack 27. The dosing lever 34 is pressed by a spring apparatus (not shown) into the position in FIG. 4. The dosing lever 34 can be swung downward by actuating the control button 8 counter to the effect of the spring apparatus. The pawl 37 is pressed into the teeth 39 of the toothed rack 27 by means of another spring apparatus (not shown).

A movable cover 40 is arranged between the pawl 37 and toothed rack 27. The cover 40 is displaceable by turning the selection wheel 10 projecting out of the side of housing 2 so that the teeth 39 of the toothed rack 27 are more or less covered.

Furthermore, a printed circuit board 41 with electronics is arranged in the upper half of the housing 2. The electronics comprise an electronic control apparatus 42. An electrical voltage supply in the form of batteries or a rechargeable batteries 43 is also located there.

The selection wheel 10 is assigned another sensor 44 that detects the rotary position of the selection wheel 10. The measured values determined by the ring sensor 22 and the additional sensor 44 are forwarded to the control apparatus 42 via the cable.

The code indicated on the flange 17 denotes the size of the respective syringe 3. The control apparatus 42 determines the respective syringe size from the measurement signals supplied by the ring sensor 22, and the respective increment from the setting of the selection wheel 10. From this, it calculates the set dispensing volume and presents it on the display 9.

The slots 6, 7 are covered on the inside by a shield 45 connected to the dosing lever 34.

According to FIG. 4 und 5, there is a flexible cover strip 46 under the slot 4 in the housing 2 for covering the slot 4. The cover strip 46 consists of polypropylene. On the ends, it is secured in the housing on both sides of the slot 4.

According to FIG. 4 und 5, the cover strip 46 runs through a channel 47 between the drawing lever holder 28 and drawing lever support 29.

Further details about the cover strip 46 and the related embodiments of the housing 2, the drawing lever holder 28 and the drawing lever support 29 are described in EP 2 656 916 A1 in paragraphs 65 to 69, the content of which is hereby incorporated in the present application.

Figure 5:
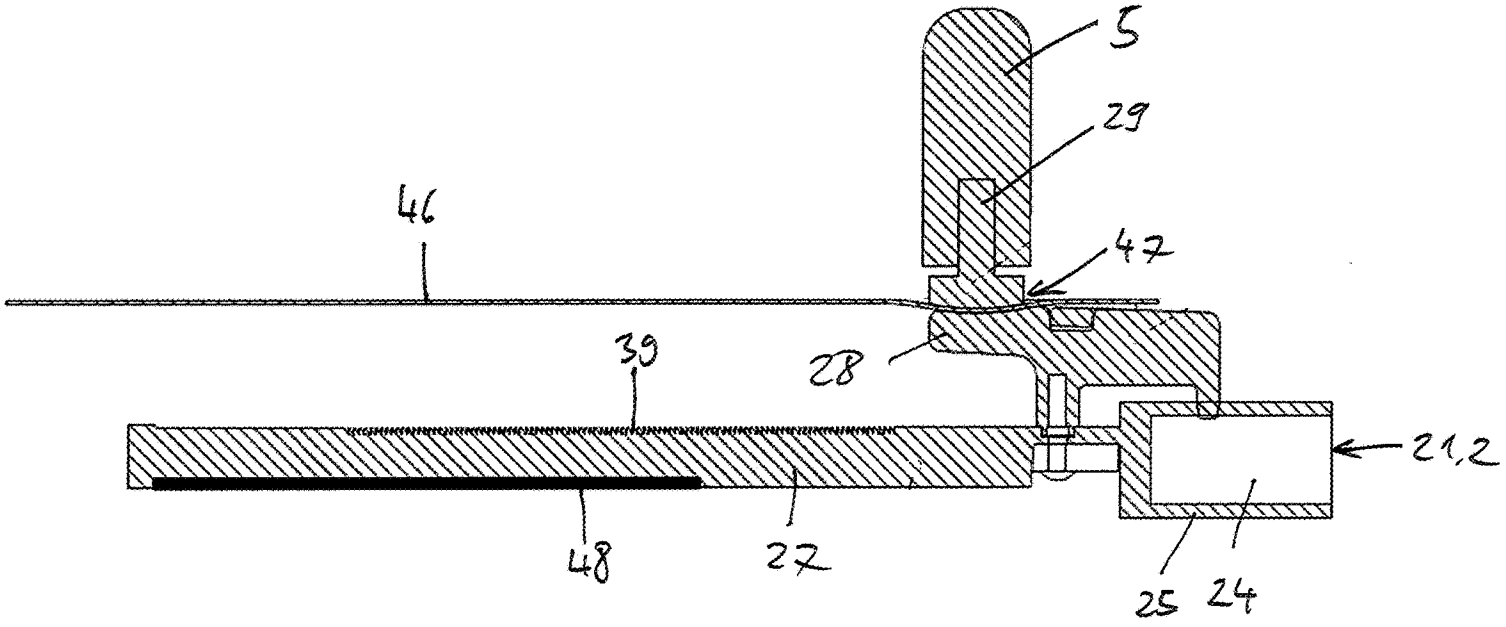
FIG. 5 shows a seat body with a toothed rack with a magnetic strip, connecting element, drawing lever and cover wall of the same pipette in an enlarged section in a longitudinal direction.

According to FIGS. 4 and 5, the magnetic strip 48 is arranged on the back of the toothed rack 27 and extends in the longitudinal direction of the toothed rack 27. In the longitudinal direction, the magnetic strip 48 comprises a plurality of sequential magnetic elements that are arranged at a predetermined distance (segmentation) next to each other. A magnetic sensor 49 is arranged on the side of the printed circuit board 41 facing the toothed rack 27, and it is suitable for detecting the displacement of the magnetic strip 48. The magnetic sensor 49 is wired to the control apparatus 42.

Moreover, the pipette has a transmission element 50 in the housing for controlling a reverse stroke when the syringe 3 is completely filled. Details on the transmission element 50 and its function are described in EP 2 656 916 A1 in paragraphs 71 to 74 and 81 to 83, as well as the figures referenced therein, the content of which is hereby incorporated in the present invention.

Figure 6:
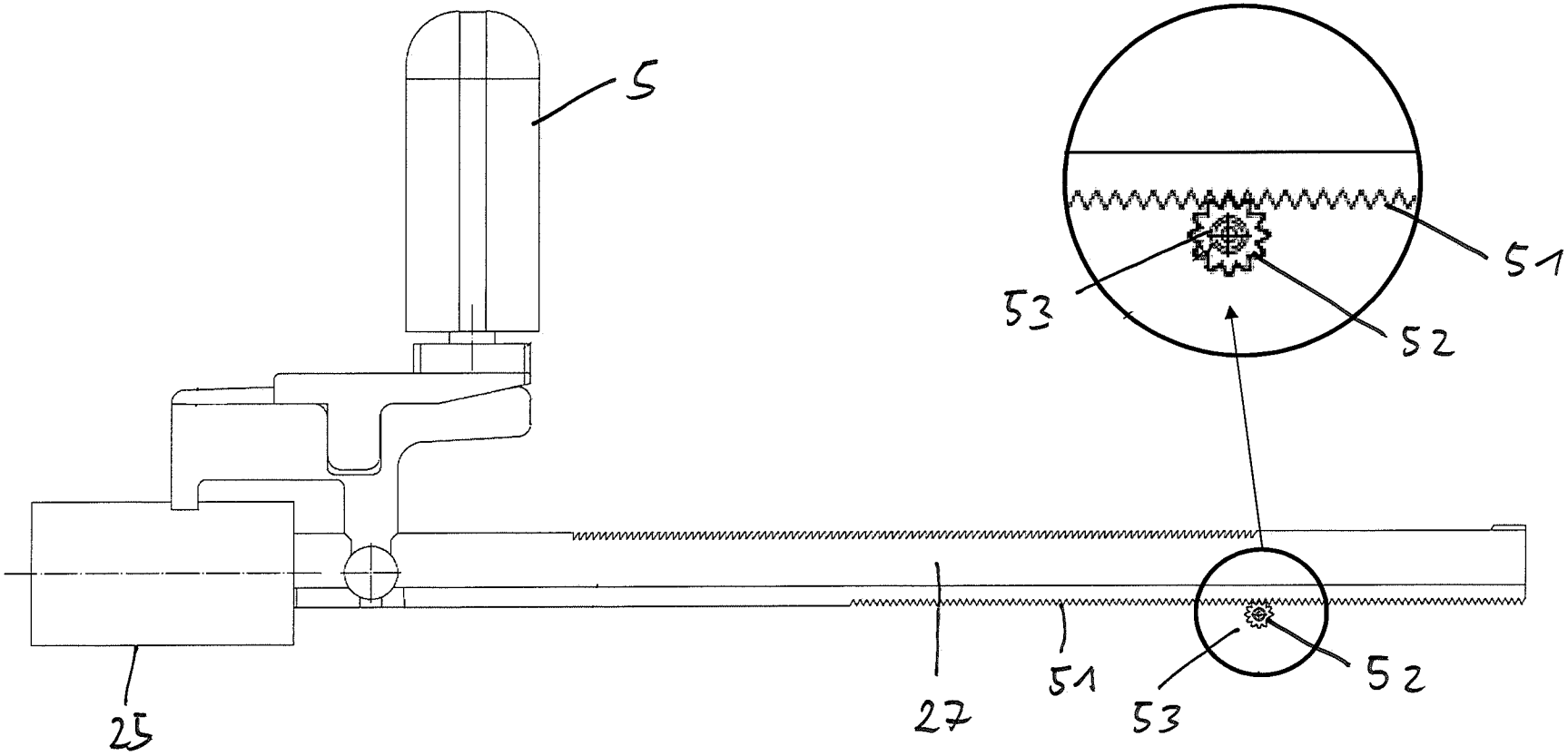
FIG. 6 shows an alternate arrangement to FIG. 5 with a rotary encoder coupled by a gear drive in a side view.

FIG. 6 shows another embodiment in which the translatory movement of the toothed rack 27 is transmitted via additional teeth 51 of the toothed rack 27 to a pinion 52 that is connected to a rotary encoder 53. The rotary encoder 53 is connected by a cable to the control apparatus 42 for reporting the respective position of the toothed rack 27.

Figure 7:
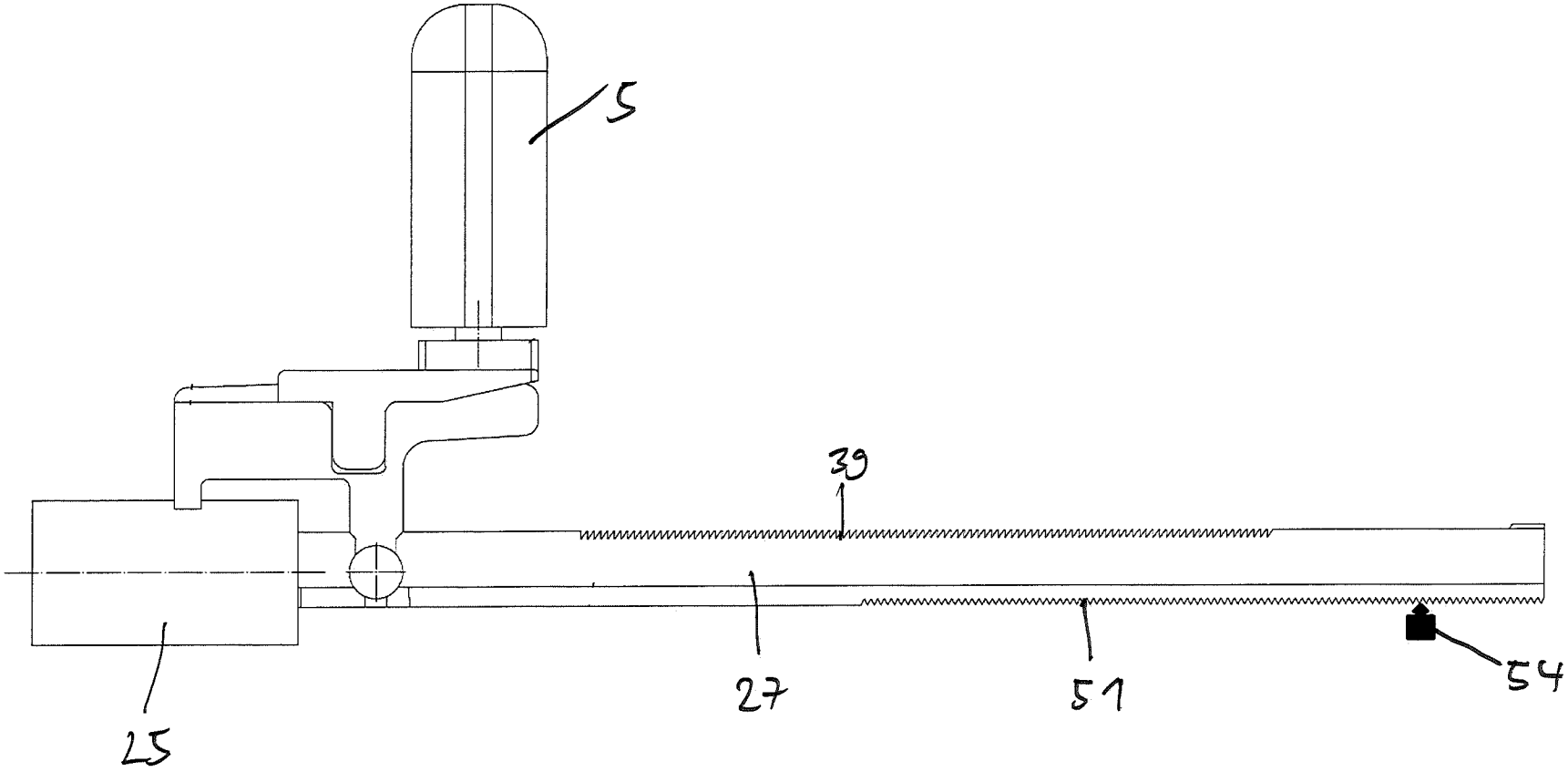
FIG. 7 shows an alternate arrangement to FIG. 5 with a contact sensor aligned with a molded-on scale in a side view.

In the embodiment in FIG. 7, a contact sensor 54 senses additional teeth 51 of the toothed rack 27. The contact sensor 54 is connected by a cable to the control apparatus 42 for reporting the respective position of the toothed rack 27.

Figure 8:
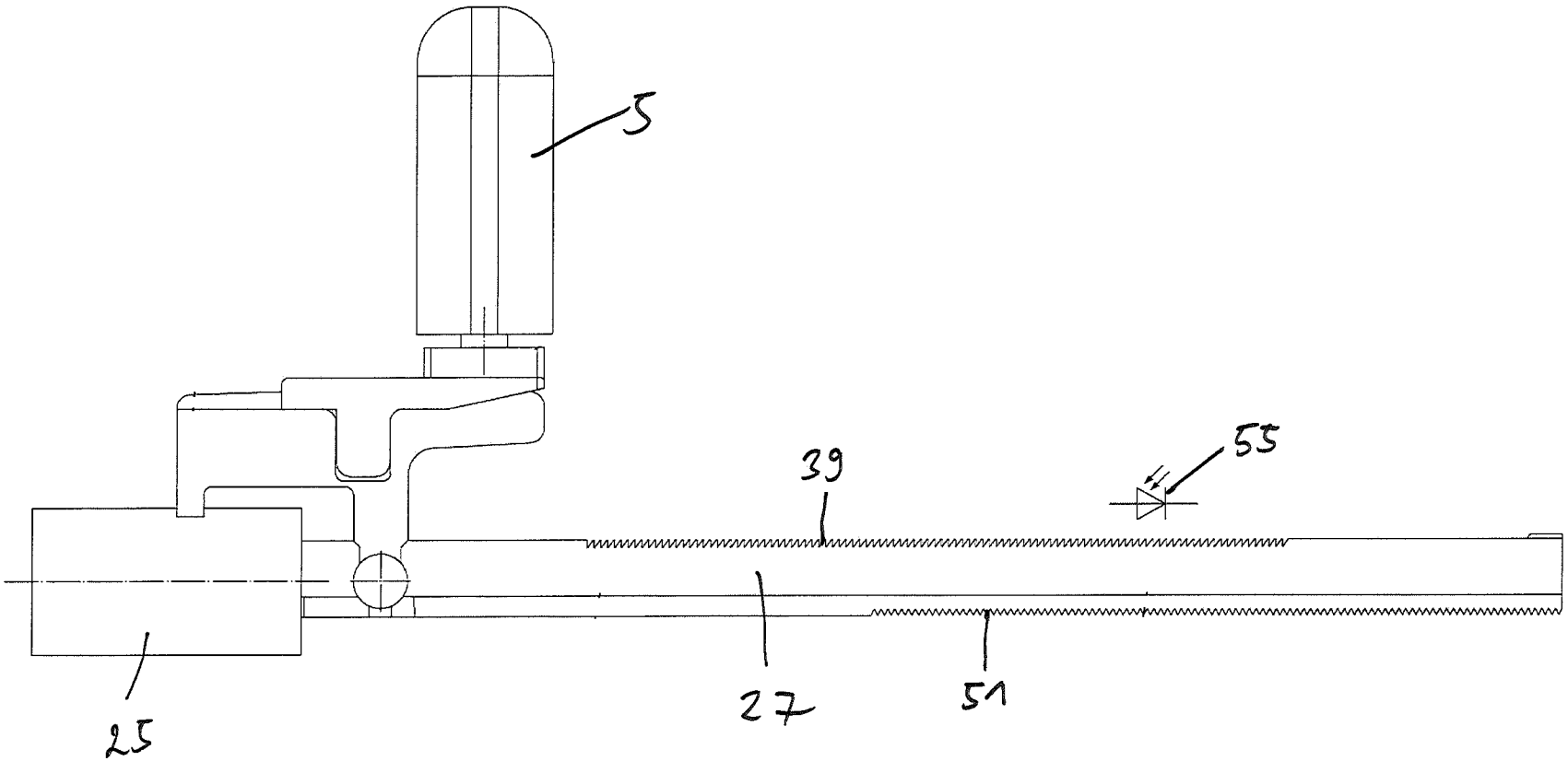
FIG. 8 shows an alternate arrangement to FIG. 5 with an optical sensor aligned with a molded-on scale in a side view.

In the embodiment in FIG. 8, an optical sensor 55 senses teeth 39, 51 of the toothed rack 27. These can be the teeth 39 that interact with the pawl 37, or additional teeth 51. The optical sensor 55 is connected by a cable to the control apparatus 42 for notifying it of the respective position of the toothed rack 27.

The use of the pipette 1 from FIGS. 1 to 5 will be explained with reference to FIG. 9. First a syringe 3 with a syringe size selected by the user is releasably connected to the pipette 1 by inserting it with the fastening section 16 in the seat 20, and with the additional fastening section 19 in the seat 24, so that the flange 22 is gripped by the gripping levers 23, and the fastening section 19 is gripped by the additional gripping levers 26.

The ring sensor 22 senses the code on the flange 17 of the syringe 3. With the signals provided by the ring sensor 22, the control apparatus 42 discerns that a syringe 3 has been inserted and turns on the display 9. With the signals provided by the ring sensor 22 and by the sensor 44, the control apparatus 42 determines the set dispensing volume and presents it on a display 9.

Moreover, the control apparatus 42 determines the possible number of dosing steps for draining the syringe 3 after complete filling, and shows them on the display 9 (block 60).

The user may change the setting of the dispensing volume using the selection wheel 10, and the changed metering volume is shown on the display 9 (block 61).

To draw liquid through the opening 14 in the syringe 3, the drawing lever 5 is pressed upward out of the position in FIGS. 1 to 3, wherein the magnetic sensor 49 detects the displacement of the toothed rack upward and forwards it to the control apparatus 42. Consequently, the control apparatus 42 controls a flashing of the display (block 62).

Likewise, the magnetic sensor 49 detects termination of the drawing of liquid by a stoppage or downward movement of the toothed rack 27, and forwards this to the control apparatus 42. Then the control apparatus 42 indicates on the display 9 the maximum possible number of dosing steps for refilling the syringe at the respective fill level (block 62).

After the reverse stroke to be executed has been performed by actuating the control button 8 once or several times, the control apparatus 42 controls the display 9 so that it stops flashing (block 63).

The performance of the reverse stroke is detected by the control electronics 42 due to the displacement of the toothed rack 27 detected by the magnetic sensor 49.

Figure 9:
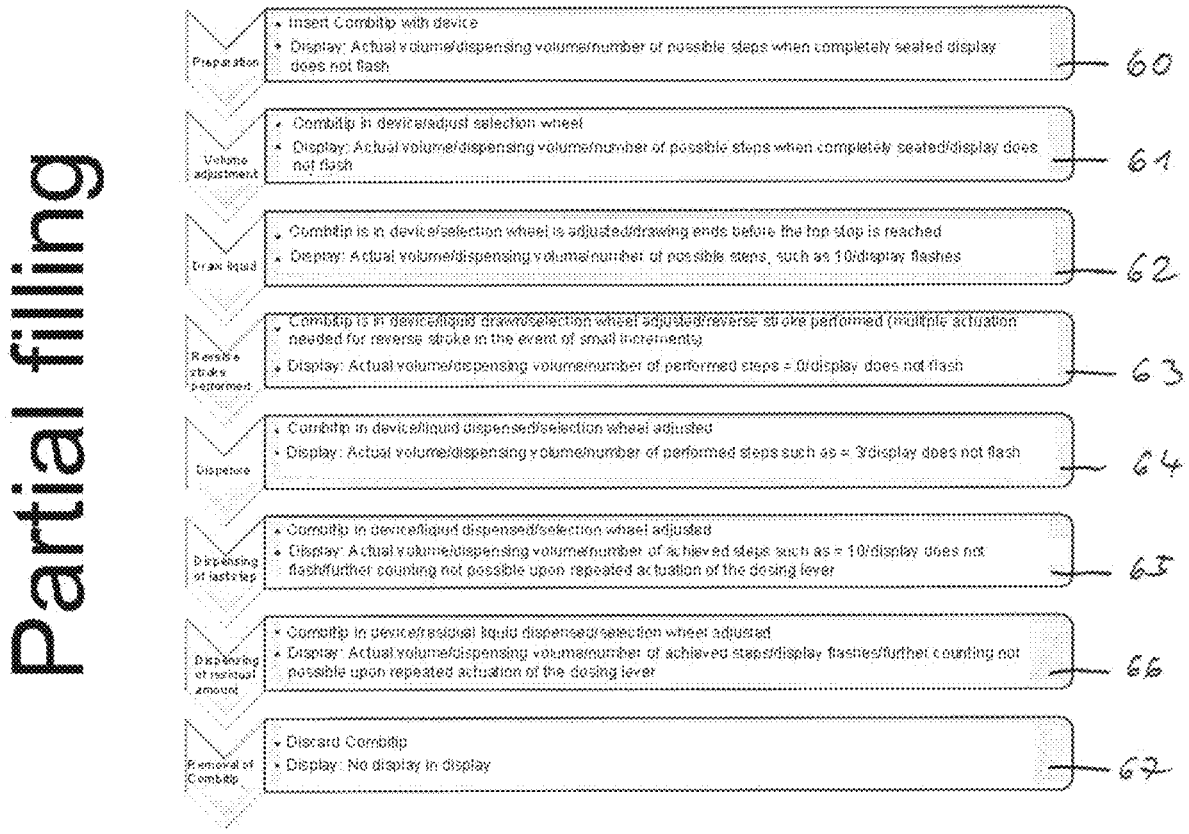
FIG. 9 shows a method for dosing when the syringe is partially filled in a block diagram.

FIG. 9 shows the steps of partial filling. Alternatively when the syringe 3 is completely filled, the maximum possible number of dosing steps without filling this syringe 3 is displayed. When the syringe is completely filled, due to the transmission element, the reverse stroke can be performed by actuating the actuation button 8 once.

Individual dosing steps are performed by repeatedly actuating the actuation button 8. The performance of dosing steps is also determined by the magnetic sensor 49 from which the control apparatus 42 calculates the number of performed dosing steps and/or the number of remaining dosing steps, and causes them to be displayed on the display 9 (block 64).

After the last complete dosing step is dispensed, the control electronics stop counting. Then fluid can again be drawn with the same syringe 3 so that the procedure continues with block 60. The control electronics 42 cause all of the performed dosing steps to be displayed (block 65).

Alternatively, the remaining fluid is dispensed by actuating the drawing lever 5. Then the control apparatus 42 controls a flashing of the display 9 (block 66) in addition to the display of the set dosing volume and the reached dosing steps.

When the syringe 3 is ejected by opening the gripping levers 23, 26, it is no longer detected by the ring sensor 22, and the control apparatus 42 switches off the display 9 (block 67).

Figure 10:
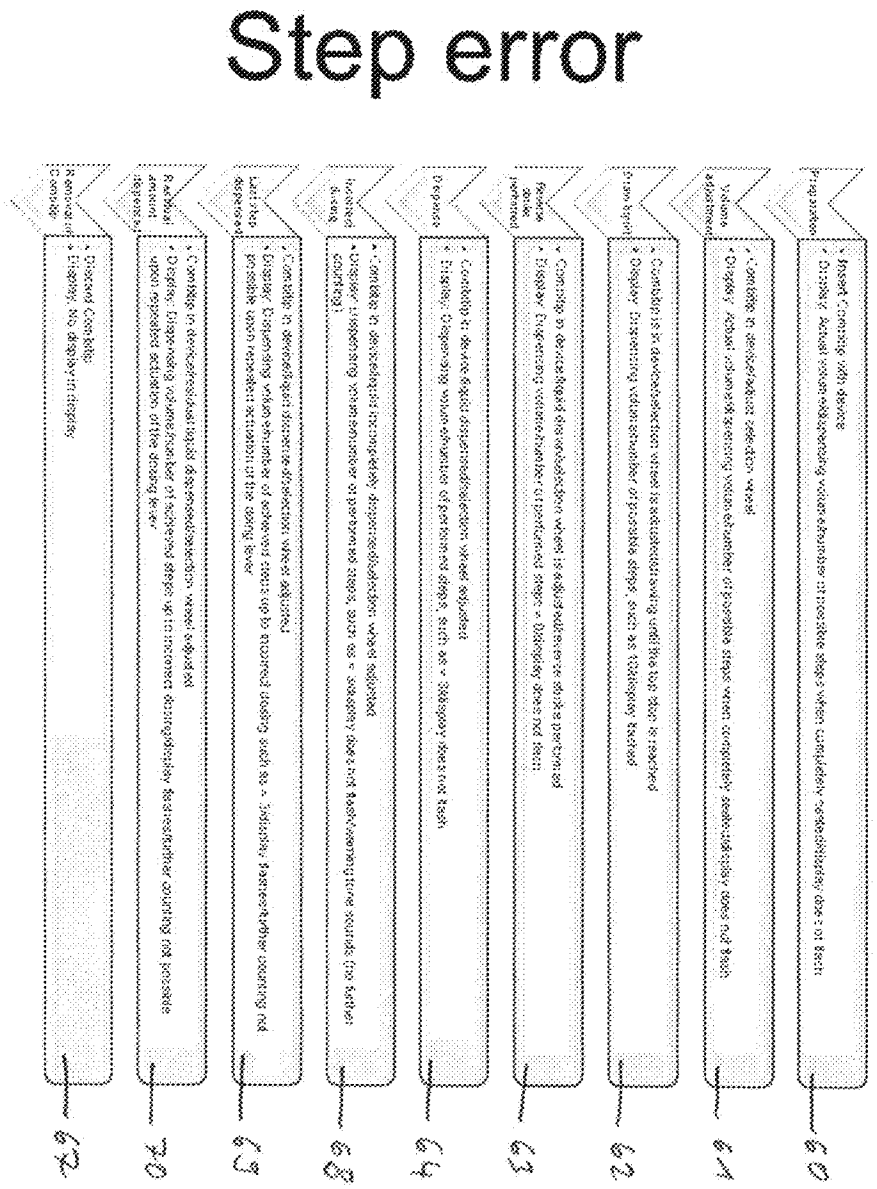
FIG. 10 shows a method for dosing in a faulty dosing step in a block diagram.

A step error will be explained with reference to FIG. 10. Blocks 60 to 64 correspond to FIG. 9.

When there is an incorrect dosing, it is determined by the control electronics 42 due to the displacement reported by the magnetic sensor 49 which does not correspond to the set dosing step. Then a buzzer emits a warning tone (block 68).

If the actuation button 8 remains actuated, the control apparatus 42 controls the display 9 so that only the number of steps performed up to the incorrect dosing is displayed, and the display flashes. In this embodiment version, it is not possible to continue counting by repeatedly actuating the actuation button (block 69).

In the next step, residual liquid can be dispensed by actuating the drawing lever 5, wherein the number of dosing steps up to the incorrect dosing is still displayed, and the display 9 flashes (block 70).

Finally, the control apparatus 42 controls when ejecting the syringe so that the display goes blank (block 67).

The entire contents of all of the references discussed above are each hereby incorporated by reference in their entirety

REFERENCE NUMBER LIST

1 Pipette
2 Housing
3 Syringe
4 Slot
5 Lifting lever
6, 7 Additional slot
8 Control button
9 Display apparatus
10 Selection wheel
11 Cylinder
12 Plunger
13 Conical section
14 Hole
15 Cylindrical section
16 Fastening section
17 Flange
18 Piston rod
19 Additional fastening section
20 Seat
21.1 Opening
21.2 Additional opening
22 Ring sensor
23 Gripping lever
24 Additional seat
25 Seat body
26 Gripping lever
27 Toothed rack
28 Drawing lever holder
29 Drawing lever support
30 Slide plate
31 Spike
32 Pivot bearing
33 Bulge
34 Dosing lever
35, 36 Legs
37 Pawl
38 Pawl tooth
39 Teeth
40 Cover
41 Printed circuit board
42 Control apparatus
43 Battery
44 Sensor
45 Shield
46 Cover strip
47 Channel
48 Magnetic strip
49 Magnetic sensor
50 Transmission element
51 Teeth
52 Pinion
53 Rotary encoder
54 Contact sensor
55 Sensor

The invention claimed is:

1. A pipette (1) for handling a syringe (3), comprising:

a rod-shaped housing (2), a seat (20) having an opening (21.1) at a bottom end of the housing (2) for inserting a syringe (3) having a fastening section (16) at the a top edge of a cylinder (11), a seat body (25) having a second seat (24) and another a second opening (21.2) at the bottom end in the housing (2) for receiving a second fastening section (19) of a plunger (12) of the syringe (3), means for releasably holding the fastening section (16) in the seat (20) and the second fastening section (19) in the second seat (24), and at least one means for displacing the seat body (25) within the housing (2) in a longitudinal direction of the housing (2), the housing further having a drawing lever (5) that can be actuated outside of the housing (2) for drawing liquid into the syringe (3), a control button (8) that can be actuated outside of the housing (2) for the a stepwise discharging of liquid from the syringe (3), an adjusting element for adjusting a dosing increment amount that can be adjusted outside of the housing (2), means for detecting the dosing increment amount set with the adjusting element, means for detecting the syringe (3) releasably connected to the pipette (1), means for detecting a respective position of the at least one means for displacing the seat body (25) during displacement of the at least one means for displacing along a path relative to the housing (2), an electronic control apparatus (42) connected to each of the means for detecting, and an electronic display apparatus (9) connected to the electronic control apparatus (42), wherein the control apparatus (42) is configured to determine a dosing volume determined by the set dosing increment amount when the syringe (3) is inserted in the pipette (1), and determine a maximum possible number of dosing steps following an execution of a reverse stroke without refilling the syringe (3) given the set dosing increment amount and the position of the at least one means for displacing on the path, and display the determined maximum possible number of dosing steps and the position of the at least one means for displacing on display apparatus (9), the control apparatus configured to determine an execution of a reverse stroke to be executed by the actuation of the control button (8), and indicates the determination of the execution of a reverse stroke to be executed on the display apparatus (9) until the reverse stroke is executed, and the control apparatus determines the number of executed dosing steps and displays the number of executed dosing steps determined on the display apparatus (9).

2. The pipette (1) according to claim 1, wherein the means for detecting the respective position of the at least one means for displacing the seat body (25) has an incremental encoder arranged on the at least one means for displacing and at least one sensor (44) fixedly arranged in the housing (2) and connected to the control apparatus (42) for detecting the displacement of the incremental encoder.

3. The pipette (1) according to claim 2, wherein the at least one means for displacing is a toothed rack (27) having a bottom end which is connected to the seat body (25) that can be engaged with a pawl (37) pivotably mounted on the control button (8) so that when the control button (8) is actuated to displace the toothed rack (27) a dosing step is completed.

4. The pipette (1) according to claim 2, wherein the incremental encoder is integral with the toothed rack (27), or is a component securely connected to the toothed rack (27).

* * * * *